United States Patent [19]

Girard

[11] Patent Number: 4,510,189

[45] Date of Patent: Apr. 9, 1985

[54] CHRISTMAS TREE ORNAMENT

[76] Inventor: Leroy Girard, 2701 Holland St., Erie, Pa. 16504

[21] Appl. No.: 412,821

[22] Filed: Aug. 30, 1982

[51] Int. Cl.[3] ..... B42D 15/02; G09F 1/06

[52] U.S. Cl. ..... 428/19; 40/124.1; 40/617; 248/489; 428/542.2

[58] Field of Search ..... 40/124.1, 156, 157, 40/158 R, 159, 539, 617; 248/489; 428/9, 18, 19, 20, 15, 542.2; D11/118

[56] References Cited

U.S. PATENT DOCUMENTS

| | | | |
|---|---|---|---|
| 192,365 | 6/1877 | Fleischmann | 40/152 |
| D. 264,452 | 5/1982 | Crawford | D11/139 |
| 1,261,133 | 4/1918 | Kidd | 40/158 R |
| 2,486,636 | 11/1949 | Egle | 428/11 X |
| 2,587,109 | 2/1952 | Carroll | 40/159 |
| 2,652,653 | 9/1953 | Ober | 428/11 X |
| 2,705,382 | 4/1955 | Smith | 428/19 X |
| 2,809,863 | 10/1957 | Curran | 428/11 X |
| 3,875,693 | 4/1975 | Pelkey | 40/124.1 |
| 4,084,015 | 4/1978 | Patterson | 428/9 |
| 4,165,573 | 8/1979 | Richards | 40/152 X |
| 4,319,418 | 3/1982 | Transport | 40/124.1 |

FOREIGN PATENT DOCUMENTS

| | | | |
|---|---|---|---|
| 18696 | 2/1972 | Australia | 46/1 L |

OTHER PUBLICATIONS

Page 95 of House Beautiful, Oct. 1960.

*Primary Examiner*—Henry F. Epstein
*Attorney, Agent, or Firm*—Charles L. Lovercheck; Wayne L. Lovercheck; Dale R. Lovercheck

[57] ABSTRACT

A Christmas tree ornament and Christmas tree is disclosed. The ornament is in the form of a card made of a rectangular support sheet with a hole through its center. A picture is supported behind the hole and a backing is supported behind the picture. The card has a support attached to one corner which is the top of the picture and a plurality of the cards are attached to the branches of the tree holding the picture in erect position and providing ornaments for the tree. The second embodiment is in the form of a front sheet and a back sheet hinged together along one edge. A picture display opening is cut out of the front or both the front and the back. Clear plastic domes are mounted in the display openings to cover pictures which are secured between the front and back sheets. Wire or string is passed through a small hole in the ornament to hang the ornament on the tree. The sheets may be a plurality in number and the ornaments may be hung from top inserts in another embodiment of the invention.

2 Claims, 18 Drawing Figures

CHRISTMAS TREE ORNAMENT

GENERAL STATEMENT OF THE INVENTION

Many types of Christmas tree ornaments are known but no ornament known to Applicant has been made up of a rectangular frame with an opening in the center with a support means at one corner and a picture supported on the card behind the opening. The card may be made with a front sheet, heavier intermediate sheet each having a hole therein with a picture supported on the intermediate sheet and a cover over the back.

REFERENCE TO THE PRIOR ART

Patents herein are known to Applicant but none of them show a Christmas tree ornament and Christmas tree of the type disclosed herein. These patents are: Nos. 2,486,636; 2,652,653; 2,809,863; and 4,165,573.

OBJECTS OF THE INVENTION

It is an object of the invention to provide an improved Christmas tree and Christmas tree ornament combination. Another object of the invention is to provide an improved Christmas tree ornament. Another object of the invention is to provide a Christmas tree ornament wherein a picture is supported behind a hole in a card and the card is rectangular in shape and has a support at its upper corner for supporting it on a Christmas tree or the like.

Another object of the invention is to provide a Christmas tree ornament that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

.

DETAILED DESCRIPTION OF THE DRAWINGS

Figure 1:
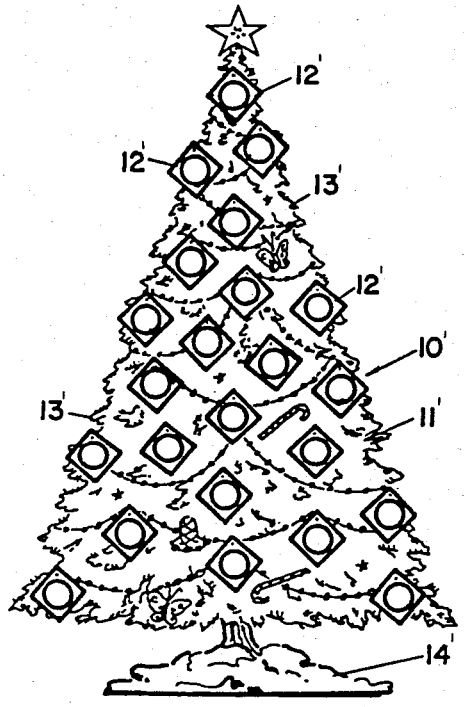
FIG. 1 is a view of the Christmas tree and ornaments according to the invention.
Figure 2:
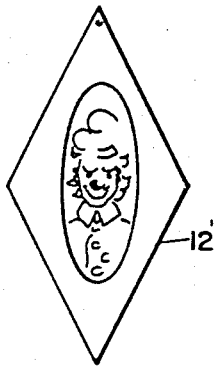
FIG. 2 is an isometric view of the Christmas tree ornament according to the invention.
Figure 3:
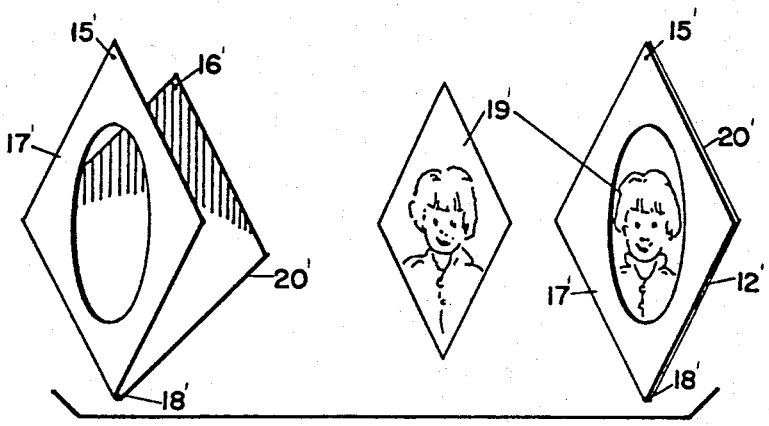
FIG. 3 is an exploded view of the ornament according to the invention showing the folded card, picture and assembled device.
Figure 4:
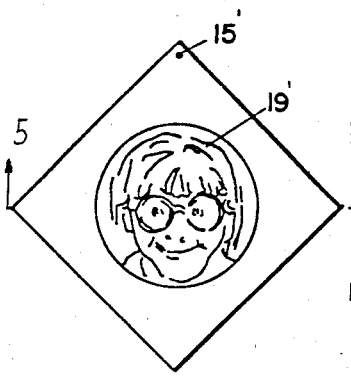
FIG. 4 is a front view of the ornament shown in FIGS. 1, 2 and 3.
Figure 5:
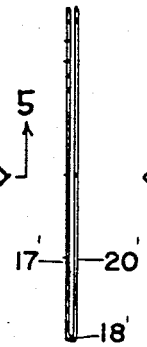
FIG. 5 is a cross sectional view taken on line 5—5 of FIG. 4.
Figure 6:
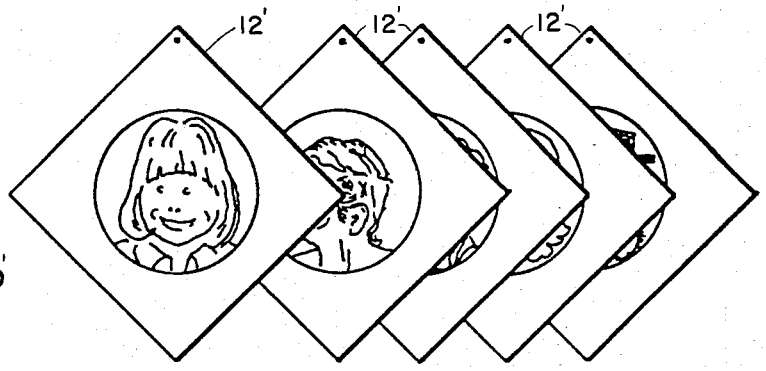
FIG. 6 shows a set of a plurality of ornaments according to the invention having different pictures on some of the ornaments.

Now with more particular reference to the drawings, FIGS. 1 through 6 show a combination 10' of a Christmas tree 11' and ornaments 12' supported on it. The tree 11' has branches 13' on which the ornaments 12' are supported. The tree trunk can be supported by a conventional foot 14'. Fasteners may be inserted in holes 15' and 16' by which the ornaments may be attached to the tree 11'. In the first embodiment of the invention, the ornament 12' is made up of a front sheet 17' and rear cover sheet 20'. The sheets 17' and 20' may be attached and folded to each other along the rear edge 18' or fastened together by means of glue or other substance.

The ornaments 12' may be attached to the tree branches by means of cord, wire, or any other suitable fastening means in holes 15'and 16'. The ornaments 12' being supported by their upper corner provides an interesting asthetic appearance in a Christmas tree ornament and makes it possible to display pictures of scenery, family members or pets. The pictures 19' can be arranged to show family history, to trace children from birth to the time at hand, historical events or the like.

The second embodiment of the invention is disclosed in FIGS. 7, 9, 10 and 11. The Christmas tree ornament 10 has a front sheet 11 and a back sheet 21. The ornaments have a hole 30 from which it can be suspended. The sheets may be folded to each other or fastened by glue or any other suitable means. The front 11 and back 21 sheets have display openings 13 and 23 cut out of them. Pictures 18 are exposed through the display openings 13 and 23 and transparent convex domes 14, shown in FIG. 9 cover the pictures. The domes have a convex part 15 and have circular flanges 16 around the eges of the convex parts 15. The flanges 16 are secured around the pictures 18 and to the sheets 11 and 21.

Figures 7, 8, 9, 10, 11, 12, 13, 14, 15, 16, 17, 18:
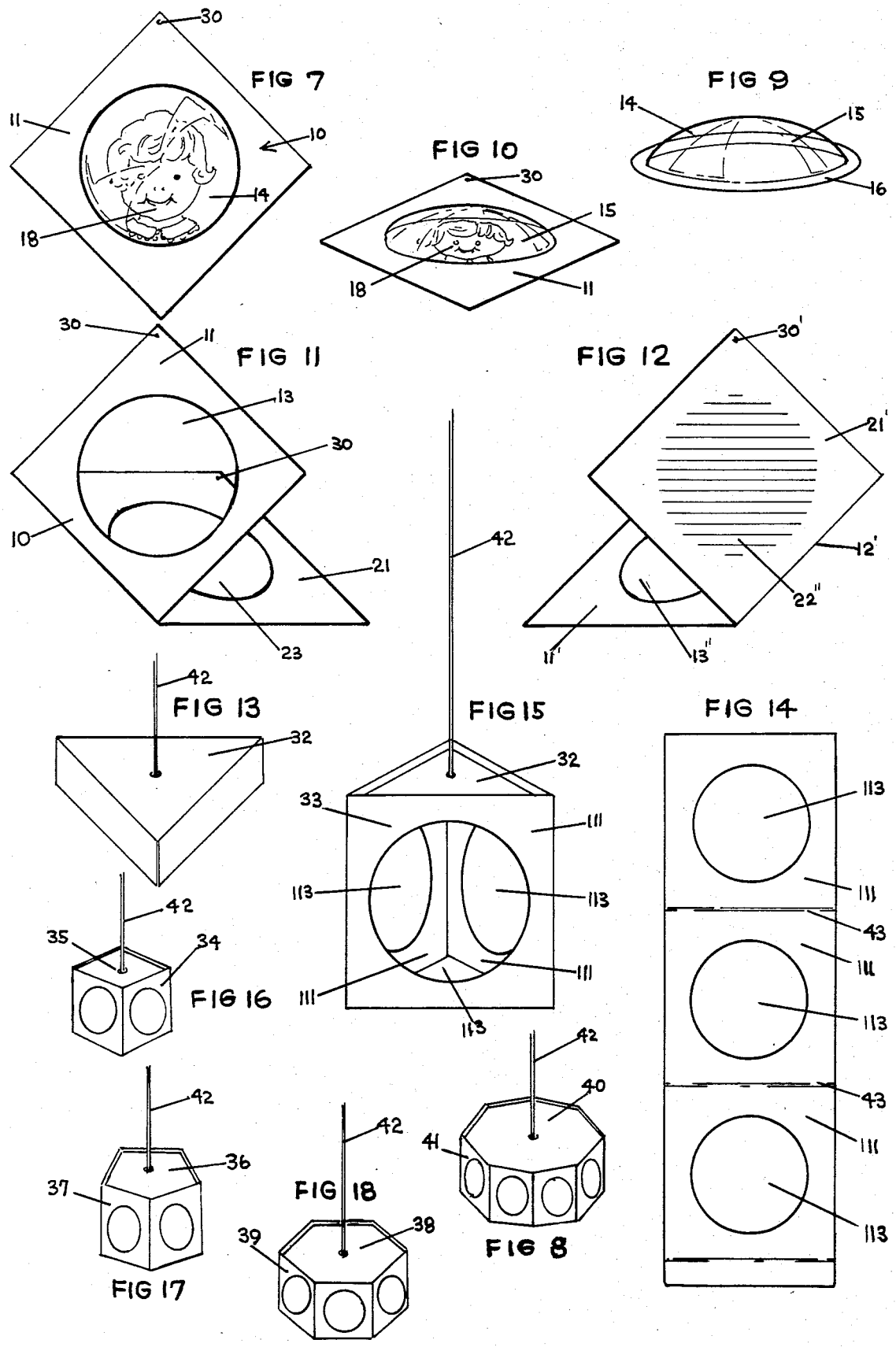
FIG. 7 is a front view of the ornament displaying a picture under a transparent convex covering.
FIG. 8 is an isometric view-of a three-dimensional ornament in the shape of an otagon to display eight pictures.
FIG. 9 is an isometric view of the transparent convex covering showing the flange that is secured between the picture and the front sheet of the ornament.
FIG. 10 is an isometric view of the transparent convex covering mounted behind the front of the ornament with the convex portion of the covering extending through the display hole.
FIG. 11 is an isometric view of a front and a back sheet, hinged together, forming an ornament. Display openings are shown in each sheet.
FIG. 12 is an isometric back view of a front and a back sheet hinged together, forming an ornament. A display opening is shown in the front sheet.
FIG. 13 is an isometric view of a triangular top insert used to suspend the ornament shown in FIG. 15.
FIG. 14 is a schematic drawing of a ribbon of three sheets with picture display openings and fold lines for assembling the ornament shown in FIG. 15.
FIG. 15 is an isometric view of a three-dimensional prismatic ornament which displays three pictures.
FIG. 16 is an isometric view of a three-dimensional cubic ornament which displays four pictures.
FIG. 17 is an isometric view of a three-dimensional ornament in the shape of a pentagon to display five pictures.
FIG. 18 is an isometric view of a three-dimensional ornament in the shape of a hexagon to display six pictures.

In the embodiment shown in FIG. 12 of the ornament 12', the back sheet 21' does not have a display opening or a transparent circular dome. There are lines 22" printed on the back of the ornament indicating space to write the story of the picture 13" displayed in the front of the ornament.

Small holes 30' in the back 21' and front sheets 11' adjacent to the upper corner of the ornament allow wire or a cord to pass through the holes to support the ornament on a tree.

The embodiment of FIGS. 13, 14 and 15 has sides 111, top 32 and openings 113.

FIG. 13 shows a three sided solid member with triangular top 32 which may be supported by a cord 42. FIGS. 14 and 15 show a ribbon forming sides with having sections 111 and opening 113 for hanging three pictures. The ribbon is folded along the hinges 43 to form the prismatic shape shown in FIG. 15. A top triangular insert 32 forms the top of the ornament. A cubic ornament, with pictures displayed in its sides 34, is made of a ribbon of four sheets with pictures and a square top insert 35, as shown in FIG. 16. A ribbon of five sheets 37 with pictures and a pentagonal top insert 36 are joined to make the ornament shown in FIG. 17. A three-dimensional ornament with six sides displaying pictures is made from a ribbon of six sheets with pictures and a hexagonal top insert 38 and sides 39, as shown in FIG. 18. The ornament shown in FIG. 8 may have eight or any other number of sides 41 with pictures and a top 40 displayed by making a three-dimensional shape of a ribbon of eight or any number of pictures desired or any other appropriate top insert.

The ornament may also have a bottom insert the same size and shape as the top insert.

The foregoing specification sets forth the invention in its preferred practical forms, but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination, a Christmas tree and ornaments, said ornaments each comprising, two sheets of relatively rigid material, said sheet each having at least one straight side, integral hinging the said straight sides of said sheets together, a round central opening in each of said rigid sheets, a plurality of generally transparent sheets of material, each said central opening having one of said transparent sheets overlying it, the central part of each said transparent sheet being generally convex and having a circular flange extending outwardly therefrom, said central convex portion of each said transparent sheet overlying a said opening and said flange resting on the particular said rigid sheet around the particular opening, and attaching means attaching said flanges to said rigid sheets, pictures supported on said flanges, and means on said ornament for attaching said ornament to said Christmas tree, said means supporting said ornaments on said tree comprises holes in the sheets and supporting means in said holes for hanging said ornaments on said tree, said rectangular sheets form a cubical shaped member with a top square insert.

2. In combination a Christmas tree and an ornament comprising, a plurality of rectangular sheets, said sheets being integrally hinged together and arranged to form the sides of a geometric shaped body having an open top and bottom, a top insert, each said sheet having an opening, said top insert forming a top to said body, and a support member attached to the top of said body thereby forming a three-dimensional body, and a means supporting said ornament on said Christmas tree, a generally transparent sheet of material, the central part of said transparent sheet being generally convex and having a circular flange extending outwardly therefrom, a picture supported on each of said flanges, said central convex portions overlying said openings and said flange resting on the particular said sheet around the said opening, and means attaching said flanges to said sheets, said ornament has a bottom insert, substantially the same shape as said top insert, said means for attaching said ornament to said Christmas tree comprising a cord attached to said top insert and extending vertically upward therefrom.

* * * * *